US006572483B1

(12) United States Patent
Hoffman

(10) Patent No.: US 6,572,483 B1
(45) Date of Patent: Jun. 3, 2003

(54) SPINNABLE SWING ASSEMBLY

(76) Inventor: Donald E. Hoffman, 27 Pinebrook Rd., Wayland, MA (US) 01778

( * ) Notice: Subject to any disclaimer, the term of this patent is extended or adjusted under 35 U.S.C. 154(b) by 0 days.

(21) Appl. No.: 10/040,661

(22) Filed: Jan. 7, 2002

(51) Int. Cl.[7] ..... A63G 9/12
(52) U.S. Cl. ..... 472/118; 472/33; 482/33
(58) Field of Search ..... 472/14, 18, 29, 472/32, 33, 34, 39, 59, 118, 119, 131; 482/29, 33, 35, 36, 69

(56) References Cited

U.S. PATENT DOCUMENTS 2,497,372 A * 2/1950 Pricer ..... 472/119
2,675,856 A * 4/1954 Abdallah ..... 182/3
3,090,617 A * 5/1963 Hjelte et al. ..... 104/53
3,130,969 A 4/1964 Groth
3,186,711 A 6/1965 Morrow
3,294,196 A * 12/1966 Rabelos ..... 182/100
3,664,665 A 5/1972 Scott
4,978,120 A * 12/1990 Greenwood ..... 297/274
5,330,398 A * 7/1994 Barbafieri et al. ..... 482/23
5,947,875 A * 9/1999 Cone et al. ..... 482/143
5,997,403 A * 12/1999 Fonti ..... 472/131

* cited by examiner

*Primary Examiner*—Kien T. Nguyen
(74) *Attorney, Agent, or Firm*—Don Halgren

(57) ABSTRACT

A playswing assembly apparatus comprising a spinning wheel having a central housing with a hub therewithin, and an elongated shaft arranged through the hub. The shaft is attached to a first and a second support arm. The first and second support arms may be adjustably connected to an overhead support to permit swinging of the spinning wheel to a to and fro swinging motion with respect to the overhead support. The hub includes a hand graspable spinning wheel rotatively supported therefrom to permit a simultaneous rotational motion to the player(s) during the to and fro swinging. A lower support may be coupled to the hub to allow further player support and yet further rotation of the player with respect to the spinning wheel and to the overhead support.

16 Claims, 5 Drawing Sheets

SPINNABLE SWING ASSEMBLY

BACKGROUND OF THE INVENTION

1. Field of the Invention

This invention relates to playground equipment and more particularly to multifunction swing assemblies for supporting one or more players.

2. Prior Art

Playground equipment has developed from simple swing and slides of the past few generations, to more sophisticated and technical apparatus on which children may play. Swings and support devices have developed, however, some of which are somewhat cumbersome and complicated. One such unusual apparatus is show in a gravity actuated ride device shown in U.S. Pat. No. 3,090,617 to Hjelte et al, wherein the participant is supported over a glide track. U.S. Pat. No. 3,130,969 to Groth shows a swing assembly with several seats available for several children to play upon. U.S. Pat. No. 3,186,711 to Morrow shows a supported globe-like device tethered to an elasticized arm. U.S. Pat. No. 3,664,665 to Scott shows an occupant propelled rotating swing which includes a rather complicated reciprocating apparatus in its hub. U.S. Pat. No. 4,978,120 to Greenwood shows a pair of rings on an elongated arm which is rotatable about a hub. The rings are used to support a child as the arm rotates in a circle. U.S. Pat. No. 5,997,403 to Fonti shows a spinning playground equipment apparatus with a child hanging on to a wheel shaped handhold. The handhold is weight activated and comprises a very complicated and costly mechanism for a single child to use.

It is an object of the present invention to overcome the disadvantages of the prior art.

It is a further object of the present invention to provide a swing arrangement for one or more children to play on simultaneously.

It is a yet further object of the present invention to provide a swing apparatus which may be added to readily, to improve the capabilities of that equipment.

BRIEF SUMMARY OF THE INVENTION

The present invention is comprises a spinnable wheel handhold play assembly for supporting one or more children from an overhead support in a playground arrangement.

The swing assembly comprises a first and a second flexible chain or cable attached to the overhead support apparatus or beam. Each chain or cable has a lowermost end which may be attached a lower member such as a relatively rigid arm or a further flexible line. The uppermost end of each lower member may be moveably attachable to various locations on the chain to provide vertical adjustability with respect thereto, or the chain itself may be adjusted at its uppermost end to the overhead support. The lowermost end of each lower member is attached to an upper ring-shaped hanger.

The upper ring-shaped hanger may be comprised of an eyebolt having a downwardly projecting threaded shaft. The downwardly projecting threaded shaft extends through a housing of the swing assembly. The housing of the swing assembly comprises a central hub having a plurality, that is preferably at least three spokes extending obtusely downwardly with respect to the longitudinal axis of the eyebolt. The spokes have a lower end which is unitarily constructed with a handhold ring, which in this embodiment is preferably circular. The shaft of eyebolt extending through the hub has a first washer at its uppermost end. The hub encloses an alignment bushing which surrounds the shaft of the threaded eyebolt. A thrust bearing is arranged on the lower-most end of the alignment bushing, and a lower washer is arranged on the bottom side of the thrust bearing and is held in place by a locking nut arrangement at the lowermost end of the threaded shaft of the eyebolt.

In the preferred embodiment there are at least 120 degrees between adjacent spokes which are spaced between the hub of the housing and the handhold ring. This spacing of the spokes permits more than one child to be safely and independently supportively suspended therefrom. The two arcuately separated chain cable supports at the upper end of the swing assembly restrict side to side motion of that swing assembly and permit only back and forth swinging thereof. The simple thrust bearing supported at the lowermost end of the alignment bushing in the hub of the housing permits rotational motion of the lower handhold ring. With this assembly, one or more children are permitted a back and forth swinging motion simultaneously with a rotational motion about the axis of the eyebolt, thus minimizing haphazard motion and contributing to the safety of the playtime.

A further embodiment of the present invention contemplates at least one light member arranged in the playswing assembly, preferably in at least one of the spokes between the hub and the lowermost handhold ring where the light may be directed downwardly upon the handhold ring and player. The lights would best be attached to a power pack or battery within the spoke or hub thereadjacent. The light in the spoke or spokes would thus permit evening entertainment by the swing assembly of the present. invention.

A further embodiment in the present invention contemplates a music box or noise maker arranged within the hub of the housing to be actuated as the hub and housing rotated relative to the lower washer on the shaft of the eyebolt.

A yet further embodiment of the present invention, a second or lower hangar may be attached to the lowermost edge. of the threaded shaft of the eyebolt. The lower hangar may have an elongated rigid arm, a flexible cable or chain attached to a chair or circular seat at its lowermost end. A rotatable coupling may be arranged between the upper end of the seat support arm or cable and the lower hangar to permit rotation of the seat or circular support surface with respect to or concurrent with the rotation of the wheel shaped handhold.

The invention thus comprises a playswing assembly apparatus including a spinning wheel having a central housing with a hub therewithin, and an elongated shaft arranged through the hub. The shaft is attached to a first and a second support arm member. The first and second support arm members may be adjustably connected to an overhead support to prevent side to side motion and limit swinging of the spinning wheel to a to and fro swinging motion with respect to the overhead support. However, a bearing member is preferably arranged between the elongated shaft and the support arms to also permit the spinning wheel rotational motion therein about the elongated shaft in addition to the to and fro swinging motion.

The spinning wheel may comprise a handhold connected to the hub by a plurality of spokes. The handhold is preferably of generally circular configuration to permit more than one player to swing therefrom. A bushing may be arranged about the elongated shaft in the hub to cushion and align the hub with respect to the shaft.

A light member may be arranged in at least one of the spokes, to permit the apparatus to be played in low light conditions. A battery may be connected to the light member by a circuit to energize the light during low light conditions. A sound generator may be arranged adjacent the hub, to permit the apparatus to be generate sounds when the spinning wheel is rotated about the elongated shaft. A lower securement member may be arranged on the elongated shaft to permit attachment of a lower support member thereon. The lower securement member may include a rotatable coupling to permit the lower support member to rotate with respect to the elongated shaft and/or the handhold.

The invention also includes a method of enjoying a playswing assembly apparatus supported from a stationary overhead support. The method may comprise swinging in a limited to and fro motion with respect to the overhead support on a handhold member supported by an elongated shaft and rotating on the handhold member about the elongated shaft as the handhold member also swings in the limited to and fro direction, arranging a lower support member from the elongated shaft, wherein the lower support member is rotatable with respect to the elongated shaft, wherein the handhold is rotatably supported around the elongated shaft by a plurality of spokes extending from a hub about the elongated shaft.

At least one of the spokes may have a light member therein to permit the playswing assembly to be utilized in low light conditions. The hub may include a sound maker to make a sound during rotation of the handhold about the elongated shaft.

Thus what has been shown is a unique and inexpensive playground apparatus which permits to and fro swinging motion in one plane, for one or more children as part of a playground assembly apparatus. That same playground assembly apparatus also permits rotational swinging of one or more children simultaneously in combination with the back and forth swinging thereof.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1:
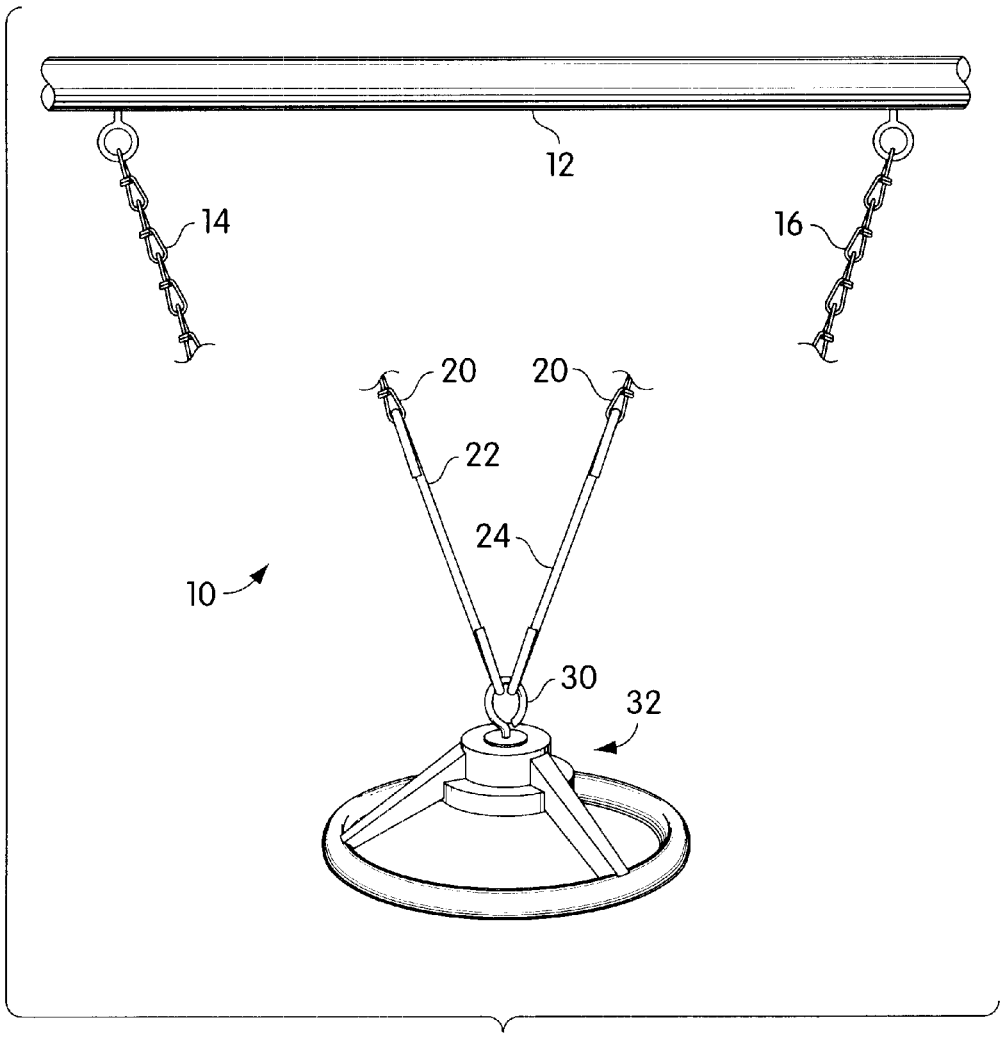
FIG. 1 is a side elevational view of a play swing assembly constructed according to the principles of the present invention.

Referring now to the drawings in detail and particularly to FIG. 1, there is shown the present invention which comprises a spinnable wheel handhold play assembly10 for supporting one or more children from an overhead support 12 in a playground arrangement.

Figure 2:
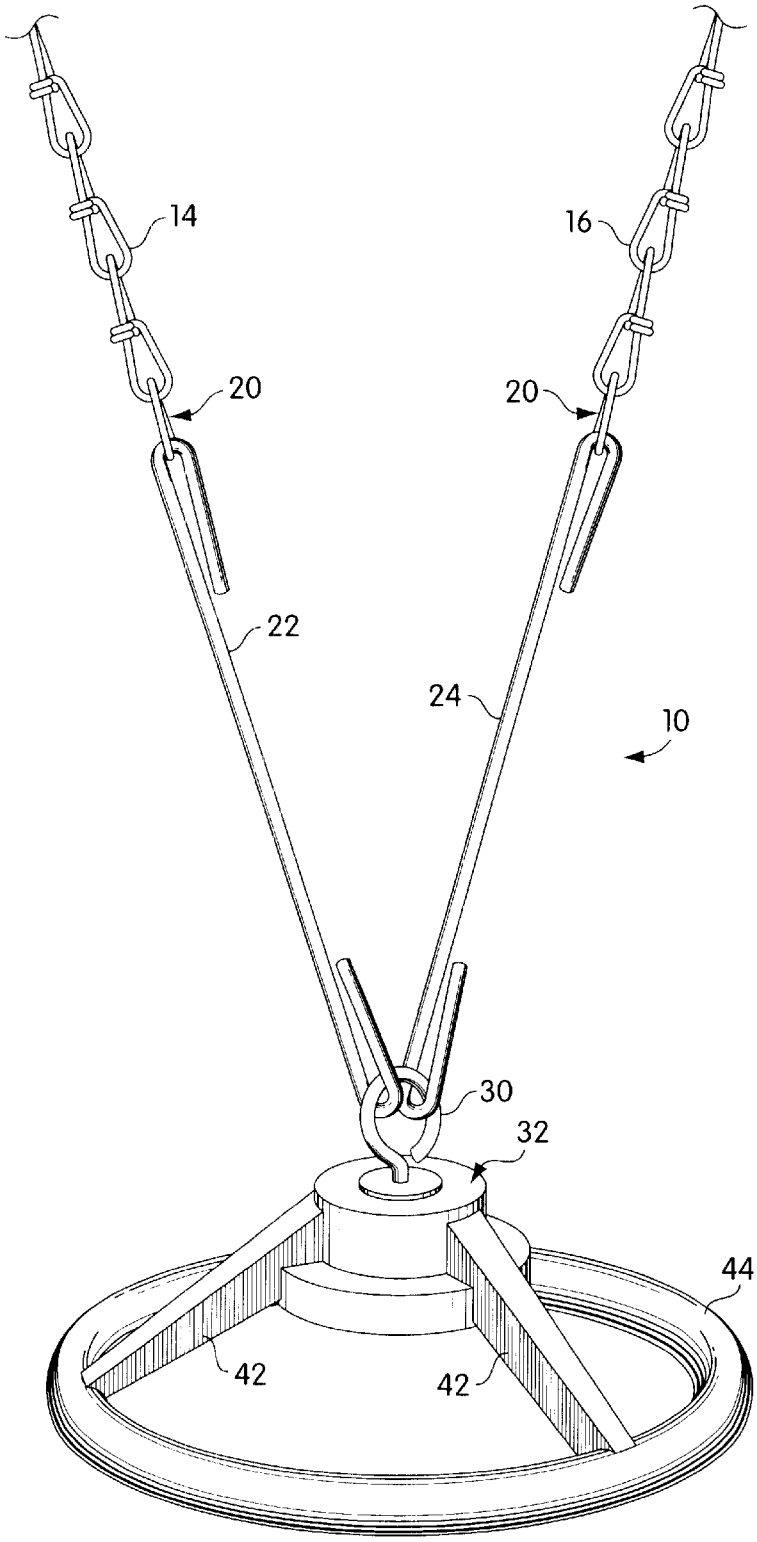
FIG. 2 is an enlarged side elevational view of the play swing assembly shown in FIG. 1.

The spinnable wheel assembly 10 comprises a first and a second member 14 and 16 such as a flexible chain or cable 14 and 16 attached to the overhead support apparatus or beam 12. Each chain or cable 14 and 16 has a lowermost end 20, each of which is attached a lowermost member 22 and 24, such as relatively rigid arm or flexible line or cable. The uppermost end of each lower member 22 and 24 may be moveably attachable to various locations on the chain 14 and 16 to provide vertical adjustability with respect thereto. The lowermost end of each lower member 22 and 24 is attached to an upper ring-shaped hanger 30 on a spinnable wheel 32, as may be seen more clearly in perspective, in FIG. 2.

Figure 3:
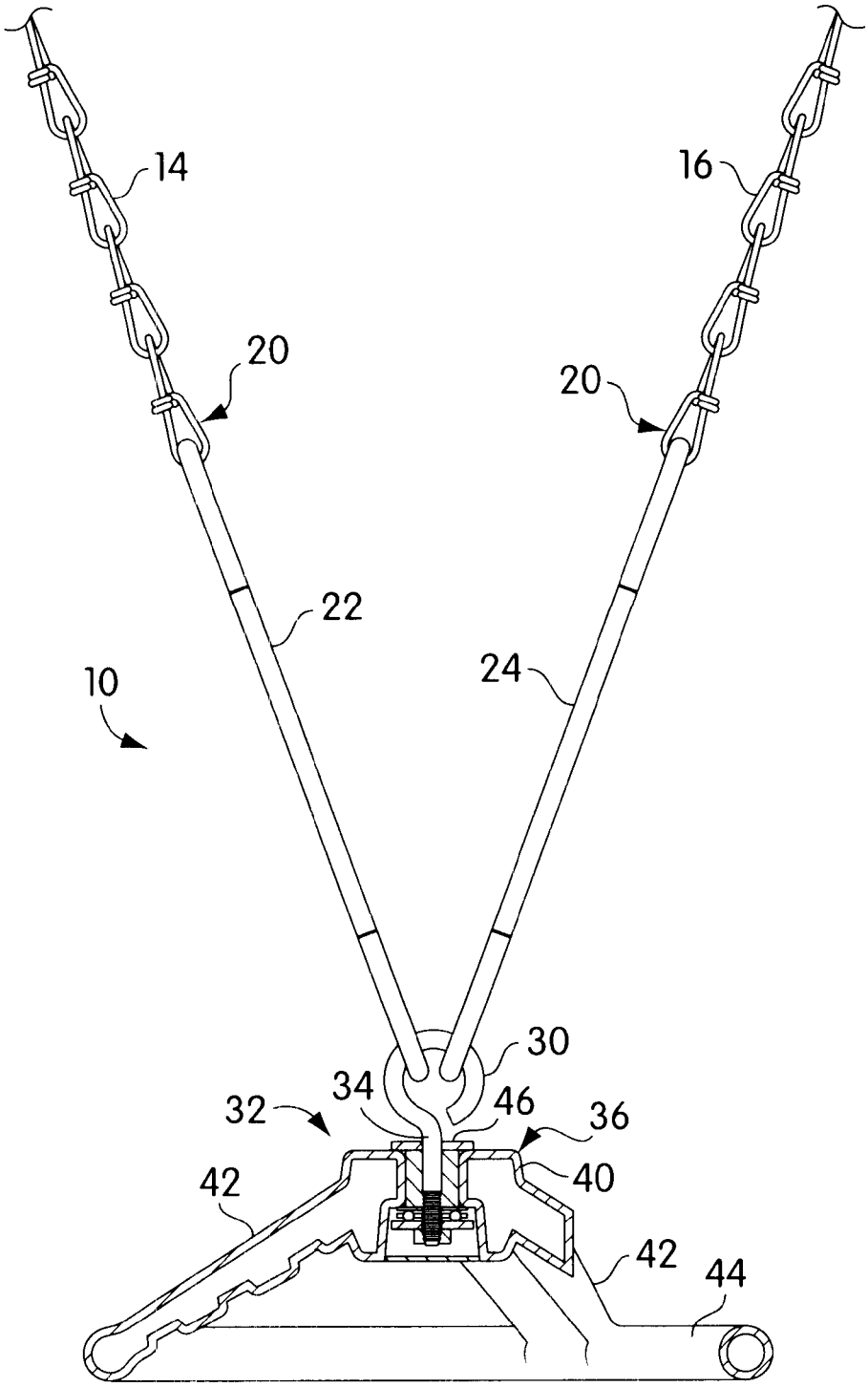
FIG. 3 is a side elevational view of the play swing assembly in section.
Figure 4:
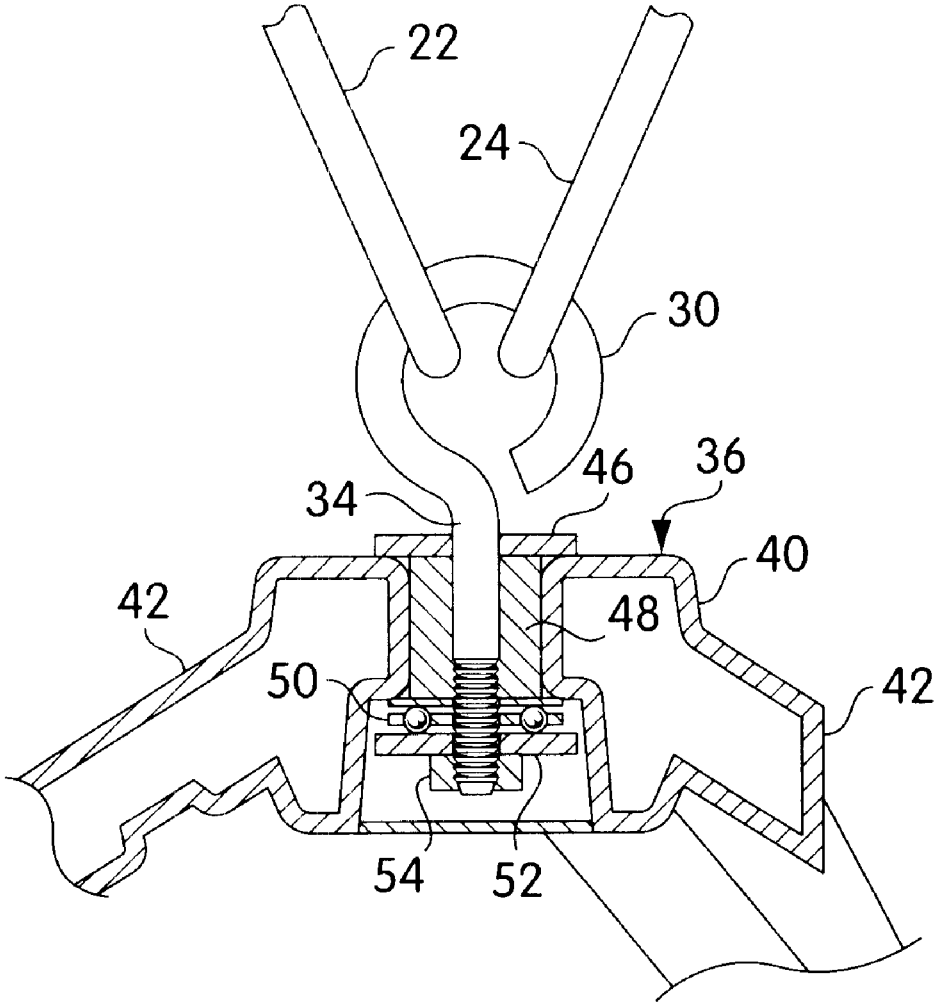
FIG. 4 is an enlarged view in section of the housing of the play swing assembly shown in FIG. 3.

The upper ring-shaped hanger 30 on the spinnable wheel 32 may be comprised of an eyebolt having a downwardly projecting threaded shaft 34. The downwardly projecting threaded shaft 34 extends through a housing 36 of the spinnable wheel 32. The housing 36 of the spinnable wheel 32 comprises a central hub 40 having a plurality of generally downwardly and sideways projecting spokes 42 (obtusively with respect to the longitudinal axis of the shaft 34 of the eyebolt. The spokes 42 have a lower end which is unitarily constructed with a handhold ring 44, which in this embodiment is circular. The shaft 34 of eyebolt extending through the hub has a first washer 46 at its uppermost end, as is shown in FIGS. 3 and 4. The hub 40 encloses an alignment bushing 48 which surrounds the shaft of the threaded eyebolt. A thrust bearing 50 is arranged on the lowermost end of the alignment bushing 48, and a lower washer 52 is arranged on the bottom side of the thrust bearing 50 and is held in place by a locking nut arrangement 54 at the lowermost end of the threaded shaft 34 of the eyebolt.

In the preferred embodiment there are at least 120 degrees between adjacent spokes 42 which are spaced between the hub 40 of the spinnable wheel 32 and the handhold ring 44 on the lower periphery of that spinnable wheel 32. This spacing of the spokes 42 permits more than one child to be safely and independently supportively suspended therefrom. The two arcuately separated chain cable supports 14 and 16 at the upper end of the swing assembly 10 restrict side to side motion of that swing assembly and permit only back and forth swinging thereof because the separation at the upper end of those supports 14 and 16 is greater than the separation of the lower support members 22 and 24 on the hanger 30. The simple thrust bearing 50 supported at the lowermost end of the alignment bushing 48 in the hub 36 of the spinnable wheel 32 permits rotational motion of the lower handhold 44 with respect to the ring-shaped hanger 30. Thus, with this assembly 10, one or more children are safely permitted a back and forth swinging motion simultaneously with a rotational motion about the axis 34 of the eyebolt (hanger 30), thus minimizing otherwise haphazard motion while contributing to the safety of the playtime.

Figure 5:
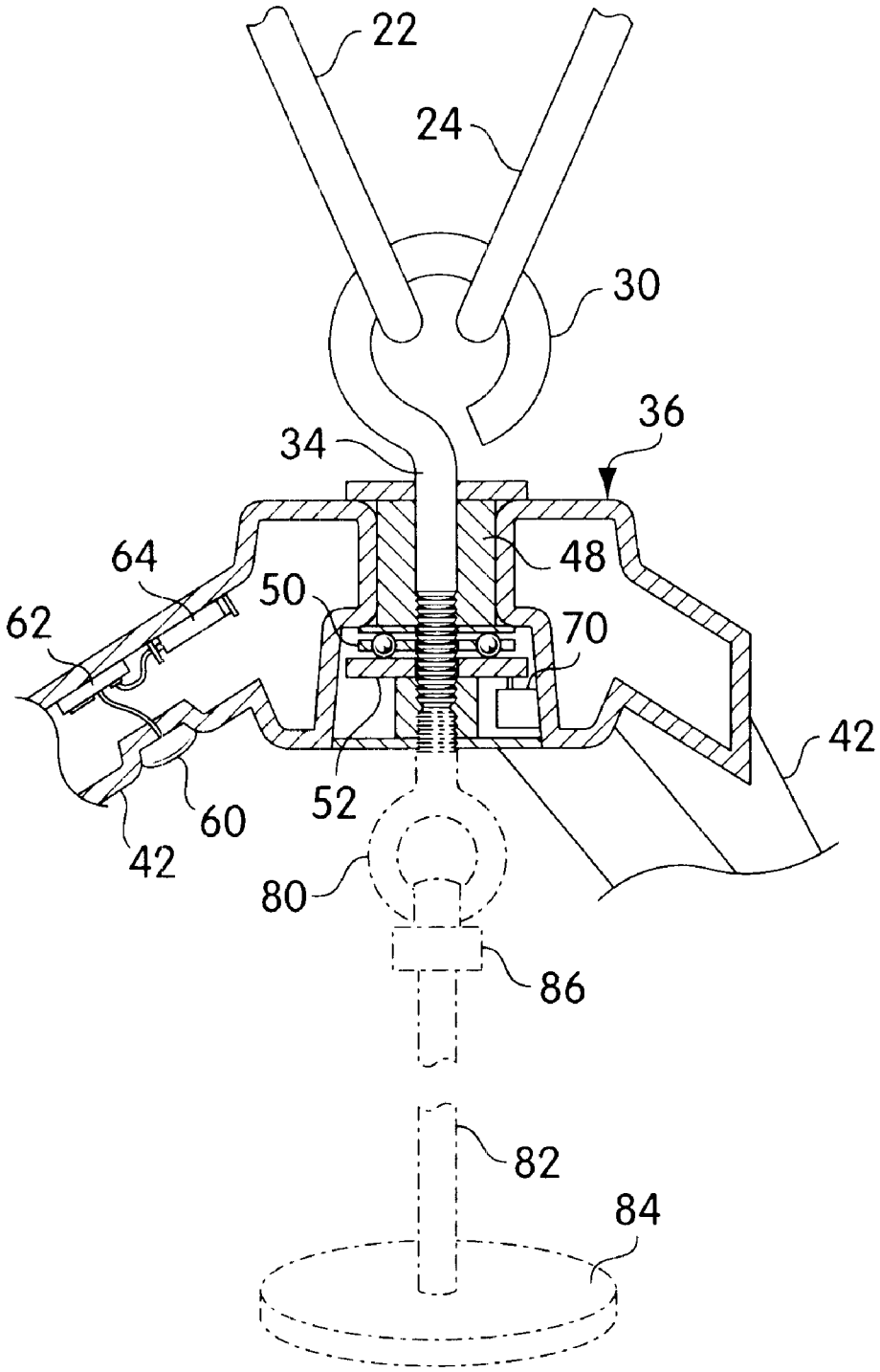
FIG. 5 is similar to FIG. 4 showing further embodiments thereof.

A further embodiment of the present invention contemplates at least one light member 60 arranged in at least one of the spokes 42 between the hub 36 and the lowermost handhold ring 44, as is partially shown in FIG. 5. The light member(s) 60 would be electrically attached through a proper circuit 62 to a power pack or battery 64 within the spoke 42 or hub thereadjacent. The light member 60 in the spoke 42 or spokes would permit evening entertainment by the swing assembly 10 of the present invention.

A further embodiment in the present invention contemplates a music box or noise maker 70 arranged within the hub 36 of the spinning wheel 32 to be actuated as the spinning wheel 32 rotated relative to the lower washer on the shaft 34 of the eyebolt, as also represented in FIG. 5.

A yet further embodiment of the present invention, comprising a second or lower hanger 80 may be attached to the lowermost end of the threaded shaft 34 of the eyebolt, as shown again in FIG. 5. The lower hanger 80 may have an elongated cable or chain 82 attached to a chair or player supporting seat 84 preferably of circular configuration, at its lowermost end. A rotatable coupling 86 may be arranged between the upper end of the seat support table and the lower hanger 80 to permit rotation of the seat or circular support surface 84 with the rotation of the wheel shaped handhold 44.

Thus what has been shown is a unique and inexpensive playground apparatus which permits restricted to and fro swinging motion in one plane, for one or more children as part of a playground assembly apparatus. That same playground assembly apparatus also permits rotational swinging of one or more children simultaneously in combination with the back and forth swinging thereof in a safe and efficient manner not shown in the art.

I claim:

1. A playswing assembly apparatus suspended from an overhead support, said playswing assembly comprising:

a spinning wheel having a central housing with a hub therewithin;

an elongated shaft arranged through said hub, said shaft attached to a first and a second support member, said first and second support members adjustably connected to an overhead support to permit swinging of said spinning wheel in a to and fro swinging motion with respect to said overhead support.

2. The playswing assembly apparatus as recited in claim 1, including:

a bearing member arranged between said elongated shaft and said support members to permit said spinning wheel rotational motion therein about said elongated shaft in addition to said to and fro swinging motion.

3. The playswing assembly apparatus as recited in claim 2, wherein said spinning wheel comprises a handhold connected to said hub by a plurality of spokes.

4. The playswing assembly apparatus as recited in claim 3, wherein said handhold is of generally circular configuration to permit more than one player to swing therefrom.

5. The playswing assembly apparatus as recited in claim 3, including a light member arranged in at least one of said spokes, to permit said apparatus to be conveniently played in low light conditions.

6. The playswing assembly apparatus as recited in claim 5, including a battery connected to said light member by a circuit to energize said light during low light conditions.

7. The playswing assembly apparatus as recited in claim 3, including a sound generator arranged adjacent said hub, to permit said apparatus to be generate sounds when said spinning wheel is rotated about said elongated shaft.

8. The playswing assembly apparatus as recited in claim 3, including a lower securement member arranged on a lower end of said elongated shaft in said hub, to permit attachment of a player supporting lower support member thereon.

9. The playswing assembly apparatus as recited in claim 8, wherein said lower securement member includes a rotatable coupling to permit said lower support member to rotate with respect to said elongated shaft and/or said handhold.

10. The playswing assembly apparatus as recited in claim 2, wherein a bushing is arranged about said elongated shaft in said hub to cushion and align said hub with respect to said shaft.

11. A method of enjoying a playswing assembly apparatus supported from a stationary overhead support, said method comprising:

swinging on a handhold member in a to and fro motion with respect to said overhead support, said handhold member supported under said overhead support by spaced apart flexible links each of which have a lower end which are connected to an elongated shaft arranged axially through a hub portion of said playswing assembly; and rotating on said handhold member about said elongated shaft in said hub as said handhold member also swings in said limited to and fro direction to permit said enjoying of said playswing by a user thereof.

12. The method as recited in claim 11, including the step of:

arranging a lower player support member from said elongated shaft, wherein said lower player support member is rotatable with respect to both said elongated shaft and to said handhold.

13. The method as recited in claim 11, wherein said handhold is rotatably supported around said elongated shaft by a plurality of spokes extending from a hub about said elongated shaft.

14. The method as recited in claim 13, wherein at least one of said spokes has a light member therein to permit said playswing assembly to be utilized in low light conditions.

15. The method as recited in claim 14, wherein said hub includes a sound maker to make a sound during rotation of said handhold about said elongated shaft.

16. A playswing assembly apparatus comprising:

a spinning wheel having a central housing with a hub therewithin;

an elongated shaft arranged through said hub, said shaft attached to a first and a second support member, said first and second support members being adjustably connected to an overhead support to limit swinging of said spinning wheel to a to and fro swinging motion with respect to said overhead support;

a bearing member arranged between said elongated shaft and said support members to permit said spinning wheel rotational motion therein about said elongated shaft in addition to said to and fro swinging motion, wherein said spinning wheel comprises a handhold connected to said hub by a plurality of spokes, wherein said handhold is of generally circular configuration to permit more than one player to swing therefrom;

a bushing arranged about said elongated shaft in said hub to cushion and align said hub with respect to said shaft;

a light member arranged in at least one of said spokes, to permit said apparatus to be played in low light conditions, and a battery connected to said light member by a circuit to energize said light during low light conditions;

a sound generator arranged adjacent said hub, to permit said apparatus to be generate sounds when said spinning wheel is rotated about said elongated shaft; and a lower securement member arranged on said elongated shaft to permit attachment of a lower support member thereon;

wherein said lower securement member includes a rotatable coupling to permit said lower support member to rotate with respect to said elongated shaft and/or said handhold.

* * * * *